US006159037A

United States Patent [19]

Madsen et al.

[11] Patent Number: 6,159,037

[45] Date of Patent: Dec. 12, 2000

[54] ILLUMINATED CONNECTOR

[75] Inventors: Brent D. Madsen, Providence; Paul Nagel, Sandy, both of Utah

[73] Assignee: 3Com Corporation, Santa Clara, Calif.

[21] Appl. No.: 09/187,175

[22] Filed: Nov. 5, 1998

[51] Int. Cl.[7] ..... H01R 3/00

[52] U.S. Cl. ..... 439/488; 439/490; 439/676

[58] Field of Search ..... 439/131, 409, 439/910, 946, 70, 751, 857, 489, 488, 490, 491

[56] References Cited

U.S. PATENT DOCUMENTS

| | | | |
|---|---|---|---|
| D. 291,071 | 7/1987 | Breil | D10/78 |
| 2,916,720 | 12/1959 | Steans | 339/91 |
| 4,186,988 | 2/1980 | Kobler | 339/176 |
| 4,241,974 | 12/1980 | Hardesty | 339/154 |
| 4,303,296 | 12/1981 | Spaulding | 339/122 |
| 4,352,492 | 10/1982 | Smith | 273/1 |
| 4,407,559 | 10/1983 | Meyer | 339/126 |
| 4,428,636 | 1/1984 | Kam et al. | 339/97 |
| 4,564,728 | 1/1986 | Romano | 179/175.3 |
| 4,620,070 | 10/1986 | Ruehl | 179/175.3 |
| 4,710,136 | 12/1987 | Suzuki | 439/374 |
| 4,778,410 | 10/1988 | Tanaka | 439/676 |
| 4,915,648 | 4/1990 | Takase et al. | 439/490 |
| 5,035,641 | 7/1991 | Van-Santbrink et al. | 439/329 |
| 5,051,099 | 9/1991 | Pickles et al. | 439/108 |
| 5,139,439 | 8/1992 | Shie | 439/359 |
| 5,183,404 | 2/1993 | Aldous et al. | 439/55 |
| 5,184,282 | 2/1993 | Kaneda et al. | 361/395 |
| 5,336,099 | 8/1994 | Aldous et al. | 439/131 |
| 5,338,210 | 8/1994 | Beckham et al. | 439/131 |
| 5,391,094 | 2/1995 | Kakinoki et al. | 49/638 |
| 5,411,405 | 5/1995 | McDaniels et al. | 439/131 |
| 5,481,616 | 1/1996 | Freadman | 381/90 |
| 5,499,923 | 3/1996 | Archibald et al. | 439/26 |
| 5,505,633 | 4/1996 | Broadbent | 439/329 |
| 5,509,811 | 4/1996 | Homic | 439/55 |
| 5,513,373 | 4/1996 | Damkier | 395/836 |
| 5,538,442 | 7/1996 | Okada | 439/676 |
| 5,547,401 | 8/1996 | Aldous et al. | 439/676 |
| 5,561,727 | 10/1996 | Akita et al. | 385/88 |
| 5,562,504 | 10/1996 | Moshayedi | 439/638 |
| 5,608,607 | 3/1997 | Dittmer | 361/686 |
| 5,634,802 | 6/1997 | Kerklaan | 439/131 |
| 5,646,816 | 7/1997 | Alden et al. | 361/622 |
| 5,660,568 | 8/1997 | Moshayedi | 439/654 |
| 5,667,395 | 9/1997 | Okada et al. | 439/131 |
| 5,679,013 | 10/1997 | Matsunaga et al. | 439/144 |
| 5,692,914 | 12/1997 | Mitani et al. | 439/131 |
| 5,727,972 | 3/1998 | Aldous et al. | 439/655 |
| 5,741,152 | 4/1998 | Boutros | 439/490 |
| 5,767,623 | 6/1998 | Friedman et al. | 313/509 |
| 5,773,332 | 6/1998 | Glad | 439/344 |
| 5,790,041 | 8/1998 | Lee | 340/815.45 |
| 5,797,771 | 8/1998 | Garside | 439/610 |
| 5,816,832 | 10/1998 | Aldous et al. | 439/131 |
| 5,876,239 | 3/1999 | Morin et al. | 439/488 |
| 5,885,100 | 3/1999 | Talend et al. | 439/490 |

FOREIGN PATENT DOCUMENTS

| | | |
|---|---|---|
| 61-256850 | 11/1986 | Japan . |
| WO 95/13633 | 5/1995 | WIPO . |

OTHER PUBLICATIONS

P.E. Knight and D.R. Smith, "Electrical Connector for Flat Flexible Cable," IBM Technical Disclosure Bulletin, vol. 25, No. 1, Jun. 1982.

*Primary Examiner*—Paula Bradley
*Assistant Examiner*—Alexander Gilman
*Attorney, Agent, or Firm*—Workman, Nydegger & Seeley

[57] ABSTRACT

The present invention relates to an illuminated connector that may provide a diagnostic display for a user. The illuminated connector may be used on such devices as computers including laptops, notebooks, and subnotebooks. The illuminated connector receives launched light energy and acts as a wave guide. Additionally, the launched light energy may be redirected by the use of selected reflective surfaces. The illuminated connector is particularly useful for structures such as a jack for a PCMCIA card, a Telco cable, and a LAN cable.

3 Claims, 4 Drawing Sheets

ILLUMINATED CONNECTOR

BACKGROUND OF THE INVENTION

1. The Field of the Invention

The present invention relates to communications connectors used in the electronics industry. In particular, the present invention relates to an illuminated jack that provides such functions as connector visibility for the user, device diagnostics for the user, and manufacturer source identification for the user.

2. The Relevant Technology

Connector technology for the communications industry is rapidly evolving to make simpler and more practical connectors to such computers as laptops, notebooks, and subnotebooks. One overriding preference is to simplify and standardize connector technology for the user in spite of the ever-increasing complexity of microcomputer devices and their abilities to perform more and more sophisticated tasks.

Connectors for modems, peripherals, and networks are also evolving while experiencing this tension between increased functional complexity of the computer device and enhanced user friendliness for the connector. For example as seen in FIG. 1, a present Personal Computer Memory Card International Association (PCMCIA) ethernet adapter cable 6 or "podule" is of a design that ultimately must be interconnected with a standard RJ-11 plug. Optionally, the PCMCIA adaptor cable 6 may be connected to a standard RJ-45 plug.

Another problem with prior art connectors is the fact that the user is often struggling to look around a corner in less than optimal lighting to make a connection with the back end or the side of an electronic device where the visibility is extremely poor. For example, the owner of a videocassette player may be making a connection between the player and the television, a computer user may be reaching around the back of a desktop computer to connect a telephone cable to the modem jack, or a portable computer user may be working in an area of extremely low light and attempting to make a connection between the portable computer and a peripheral device cable.

It is also preferable that the PCMCIA adapter cable be eliminated such that, overall, the computer hardware is simplified for the user and fewer parts are required that may otherwise be misplaced, damaged, and individually managed.

FIG. 1 also shows two light emitting diodes 8 (LED) located on the rear housing of PCMCIA ethernet adapter cable 6. Unfortunately, these LEDs need to be hand-soldered onto an internal printed circuit board (PCB) or to terminals on the connector. Additionally, the LEDs, because they must be hand-soldered, need to have their leads sleeved to prevent shorting thereby to the shield of PCMCIA ethernet adapter cable 6 or elsewhere. Both operations tend to higher cost and increased likelihood of field failure.

Another aspect of prior art adapter cables and the like is the use of the adapter cable itself or the connector housing to identify the manufacturer. As such, a company logo could be typically silk-screened or molded onto the adapter cable lead housing 4 to advertise to the user that some of the hardware attached to the computer was obtained from a particular source.

One prior art innovation eliminates the connector cable entirely and provides either a recessed jack connector or an extendable jack connector such as XJACK® or an alligator jack as part of the modem card. However, it typically remains standard throughout all of the connector industry, that connectors are required to have certain qualities in order to comply with safety standards. For example, the tip and ring characteristics of voltage in a telephone line requires the jack to have the same qualities that exist in a 110 volt line cord and its connectors. Additionally, the material of which the jack is made needs to be a primary electrical support such that it abides by certain flammability requirements and resists arcing in spite of the required electrical ring voltage. As such, connector jacks have been made of materials such as ULTEM® which is a polyetherimide, made by GE Plastics of Pittsfield, Mass.

Besides having the electrical safety qualities, the connector jack also needs to have certain strength qualities in order to not fracture during ordinary use. Such qualities require the addition of fibers and other strengthening additives to the jack material such as glass or carbon fibers. As a result of the manufacturer's meeting all of the above and other standards, connector jack materials have typically been made of opaque compounds that for example have been grey or black.

SUMMARY AND OBJECTS OF THE INVENTION

The present invention relates to an illuminated jack for making connections between two electrical devices. The present invention may be applied to such receptacles as a telephone jack. The present invention may also be applied to such receptacles as a computer ethernet jack, a modem jack, or a peripheral jack. The present invention may also be applied to such receptacles as a television antenna jack, a video cassette recorder (VCR) cable jack, a video game unit, and the like. The present invention is particularly adapted to providing an illuminated jack for a computer device. In particular, the present invention is particularly useful for providing an illuminated jack for a PCMCIA ethernet card or a modem card.

A first preferred embodiment of the present invention relates to a jack for receiving an RJ-11 plug, an RJ-45 plug, a Telco plug, or a local area network (LAN) plug or the like. In the present invention, the inventive illuminated jack is made of a translucent material that meets or surpasses UL® standards. Such safety standards include electrical resistivity, resistance to flammability, and structural strength.

The present invention provides a jack connector with several qualities for receiving a plug. First, the jack may be illuminated with a light source such as an incandescent light, an LED, and the like that makes it more visible. For purposes of this disclosure, the light source used to illuminate the jack will be referred to by non-limiting example, as an LED. The jack may also be configured with reflective surfaces in order to achieve a preferred local illumination somewhere upon the jack surface for both product identification and for a diagnostic display to the user. The jack also acts as a diagnostic display to the user. The jack may also display a manufacturer's source name.

A first embodiment of the present invention comprises a jack that is fixed at or near the edge of a computer and that is substantially illuminated by an LED. In other words, the fixed jack is substantially not moved from the edge of the computer by the user during its use or at any other time except to remove or replace the jack. For such a jack, the LED shines upon the translucent jack housing and light from the LED may be redirected to preferred portions thereof by the configuration of at least one reflective surface.

Preferably, substantially all surfaces of the fixed jack can be coated with a reflective material that causes substantially all light to exit the jack through the face that is exposed to the user. The fixed jack may be internally connected by a flexible circuit strip or by a circuit board (PCB) track-and-runner configuration.

In another embodiment of the present invention, a jack that is extendable beyond the edge of a computer such as an XJACK® is made of translucent material and is illuminated by an LED that is positioned within the computer, preferably upon a PCB. Light may be preferentially redirected and/or blocked within the XJACK structure by the placement of selected reflective surfaces that may be painted or otherwise adhered to the body of the translucent jack. The XJACK may be connected internally by a flexible circuit or preferably by the inventive PCB track-and-runner configuration.

In another embodiment of the present invention, an alligator jack is provided that is translucent and that may likewise be illuminated by an LED. Additionally, reflective surfaces may be placed within the alligator jack to redirect light according to a preferred configuration. As with the fixed jack and the XJACK, the alligator jack may also be preferentially painted or coated with a reflective material so as to cause launched light to exit through selected local areas of the translucent body of the jack.

Another aspect of the present invention provides a diagnostic display as the illuminated jack such that the user may glance at the jack and determine by its illumination or that lack thereof, its color, its blinking its combination of more than one color, its combination of blinking and color, its combination of blinking with more than one color, and by other modes, what particular functions the computer is carrying out.

Another aspect of the present invention provides for product identification by the illumination of the jack and particularly by concentrating light from the light source such as an LED to illuminate selected regions of the jack that may carry a product identification logo, icon, name, or the like.

It is therefore an object of the present invention to provide a simplified method of connecting microcomputers to outside sources such as peripherals, modem cards, modems, and networks. It is also an object of the present invention to provide a simplified method of connecting telephones to telephone jacks where the telephone jack is illuminated. It is also an object of the present invention to provide a method of connecting electronic devices that contain illuminated, translucent jacks for such devices as televisions, VCRs, video game units, and the like.

It is also an object of the present invention to eliminate the need for a separate adapter cable that makes a connection between a standard RJ-11 plug or RJ-45 plug and the like and the microelectronic device itself It is also an object of the present invention to provide a simplified connection to a microcomputer that maintains safety standards of resistance to electrical voltage arcing and flammability.

It is also an object of the present invention to provide a connector to a microelectronic device that provides a simplified diagnostic output to the end user. Additionally, it is an object of the present invention to provide a connector to a microelectronic device that is visible in an area of low light.

It is another object of the present invention to combine simplified interconnectivity and a diagnostic output in a connector. It is also an object of the present invention to provide simplified interconnectivity and a diagnostic output with commercial product identification. It is also object of the present invention to provide simplified interconnectivity, jack visibility, diagnostic output, and commercial product identification.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
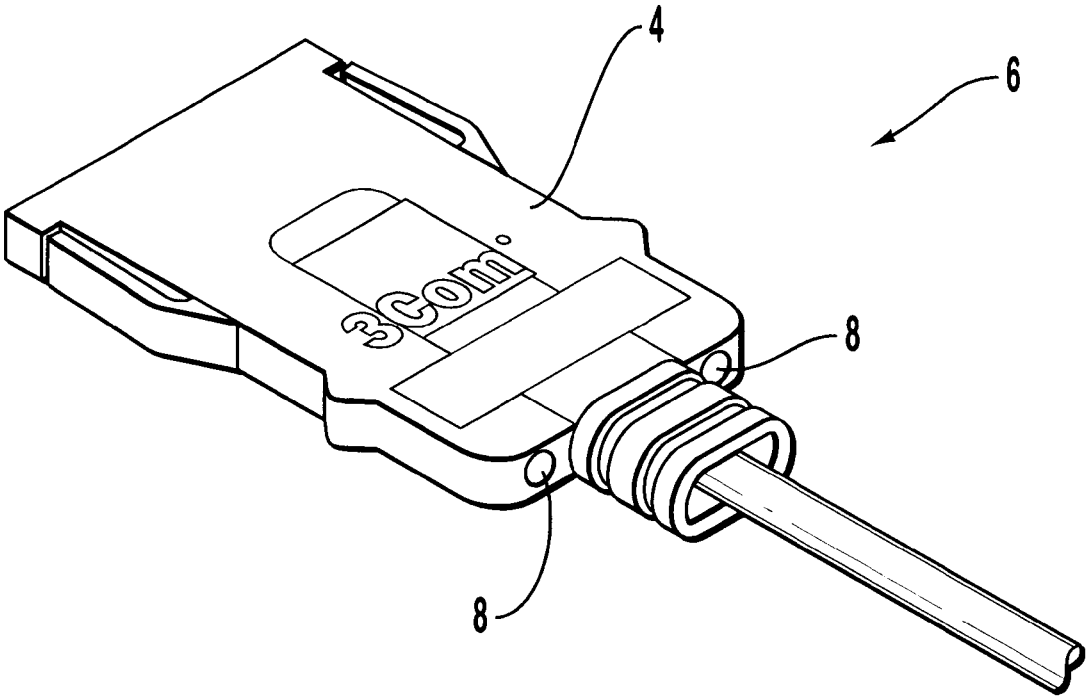
FIG. 1 (PRIOR ART)
FIG. 1 is perspective view of a prior art adapter cable.

As used in this specification, the phrase PCMCIA communications card refers to a communication card falling within the Personal Computer Memory Card International Association memory card parameters for communications cards having a thickness less than the thickness of a miniature modular jack physical/electrical media connector.

The term miniature modular jack, physical/electrical media connector, fixed jack, XJACK, alligator jack, and the like, connotes a media connector that may have qualities such as those connectors having physical attributes described in F.C.C. Part 68, Subpart F. Specific terms such as RJ-type, RJ-11, RJ-45, 6-pin miniature modular plug, 8-pin miniature modular plug, etc. are all references to specific exemplary physical/electrical media connectors falling within the broader parameters of the term physical/electrical media connectors, etc., and should not be used to limit the scope of the invention to specific connectors.

The present invention relates to a connector comprising a connector composition made of translucent material that has at least one translucent external perimeter portion and an aperture for a plug. The connector includes a means for receiving launched light energy at the perimeter into at least some of the connector composition and a means for broadcasting the light energy out of at least a portion of the connector perimeter.

As applied to the computer industry, the present invention relates to a computer communication connector comprising a substantially translucent material configured with an aperture for receiving a plug. The substantially translucent material is preferably made of a unitary article such as a thermoplastic or a glass. By "unitary article," it is understood that the article is formed, molded, or machined from substantially a single piece of material.

The connector also includes a means for launching light energy into the connector. An example of a means for launching light energy into the connector is an LED. Another example for a means for launching light energy into the connector is a plurality of LEDs. Another example of a means for launching light energy into the connector is an incandescent light source. Another example of a means for launching light energy into the connector is a plurality of incandescent light sources having dissimilar wavelengths. Another example of a means for launching light energy into the connector is a combination of at least one incandescent light source and at least one LED.

The connector may also include a first means for redirecting light energy within the connector body and a second means for redirecting light energy within the connector body. An example of the first means for redirecting light energy within the connector body is a portion of the perimeter of the connector that is set at a non-perpendicular angle to the incidence of the launched light such that a substantial portion of the launched light is reflected therefrom. Another example of the first means for redirecting light energy within the connector body is a polished portion of the perimeter that is set at a non-perpendicular angle to the incidence of the launched light.

The second means for redirecting light energy can be any number of reflective surfaces or one of them as is set forth below. In particular, one of the second means for redirecting light energy within the connector body acts as a limiter to restrict the path of the light energy to selected areas of the connector.

Figures 2A, 2B, 2C, 2D, 2E, 2F:
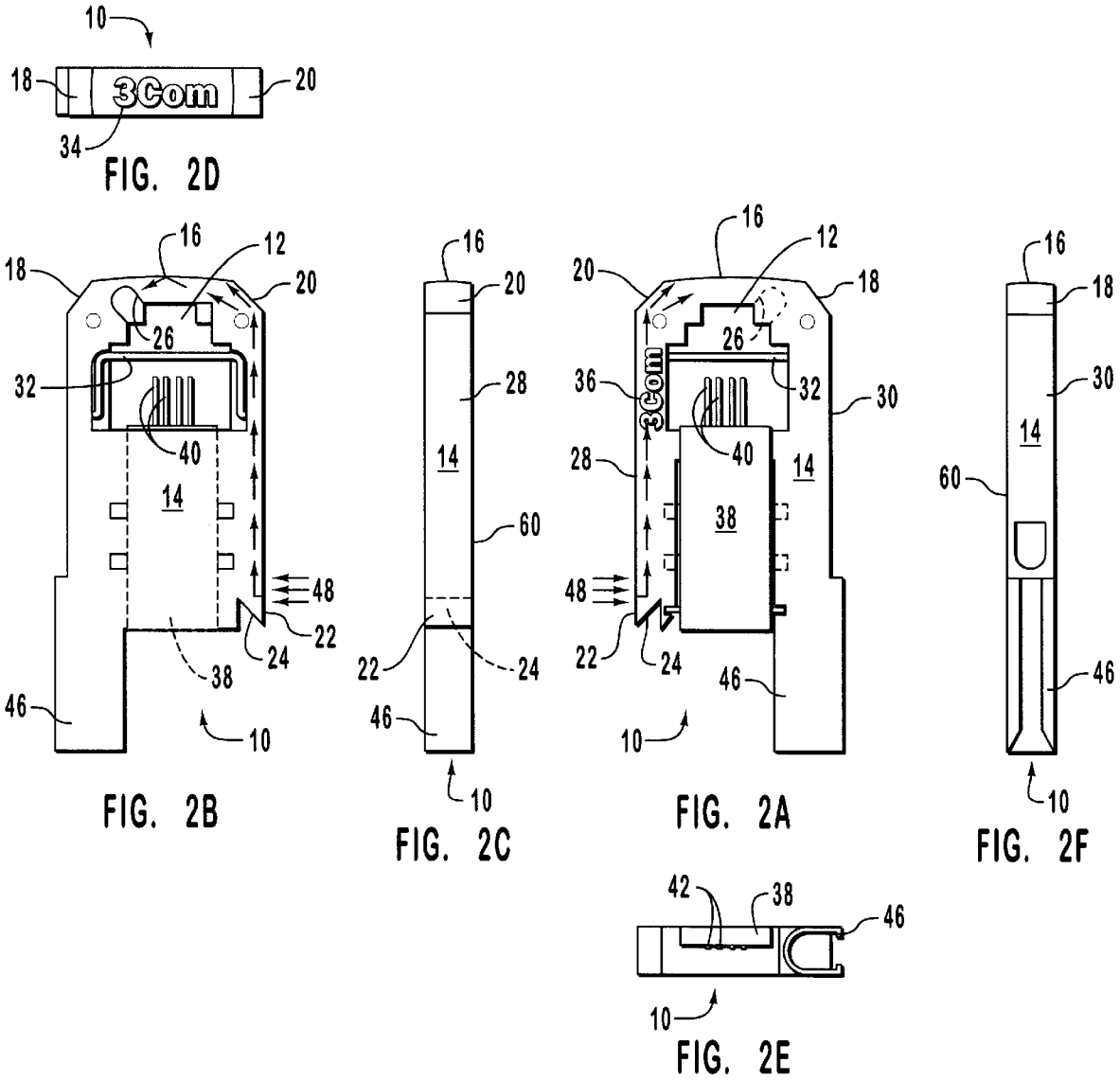
FIG. 2A is a top plan view of an inventive extendable and retractable XJACK.
FIG. 2B is a bottom plan view of the inventive XJACK depicted in FIG. 2A.
FIG. 2C is a first elevational side view of the inventive XJACK depicted in FIG. 2A.
FIG. 2D is an elevational end view of the inventive XJACK depicted in FIG. 2A.
FIG. 2E is an elevational back view of the inventive XJACK depicted in FIG. 2A.
FIG. 2F is a second elevational side view of the inventive XJACK depicted in FIG. 2A.

FIGS. 2A through 2F illustrate a first embodiment of the present invention. FIG. 2D is a top plan view of a connector 10 that is an XJACK for a laptop, notebook, subnotebook computer and the like. An aperture 12 is provided in connector 10 to receive a plug (not pictured). Connector 10 includes a translucent body 14 and a contact pin insert 38. Translucent body 14 includes a terminal surface that may be flat or arcuate. As such, the terminal surface as is understood within the present invention will be referred to as an arcuate surface 16. Thus, translucent body 14 includes arcuate surface 16, a right bevel 18, and a left bevel 20. Along the sides of connector 10 is a first side surface 28 and a second side surface 30. A top surface 60 joins first side surface 28 and second side surface 30. A stirrup 32 may be provided within aperture 12. Connector 10 is illuminated by piping launched light 48 as depicted, as a series of short arrows, along first side surface 28.

Launched light 48 enters connector 10 at a portion of the perimeter thereof that acts as a light receiver lens 22. It is understood that light receiver lens 22 may be simply a portion of the translucent first side surface 28 of connector 10. Launched light 48 may be redirected toward the area that included arcuate surface 16 by the placement of a first reflective surface 24. First reflective surface 24 may comprise an exterior surface formed in connector 10 that is set at a non-perpendicular angle to the path of launched light 48 such that first reflective surface 24 substantially reflects all of launched light 48 that impinges thereon.

The angle required to substantially reflect all of launched light 48 typically is configured at 45°. However, the specific and optimum reflective angles are materials-dependent. Within the scope of the present invention, the angle of first reflective surface 24 to the direction of launched light 48 may be understood to be in a region between 10° and 80°, preferably between 25° and 65°, more preferably between 40° and 50°, and most preferably about 45°. That the angle of first reflective surface 24 in respect to the direction of launched light 48 may lie outside the aforementioned ranges, would depend upon a particular material and the amount of launched light 48 that is desired to be reflected by first reflective surface 24. One example of providing reflective 24 at an angle outside the aforementioned range would be where at least a portion of launched light 48 is preferably to pass through reflective surface 24, although another portion of launched light 48 is configured to reflect off of reflective surface 24.

An example for the means for receiving launched light energy at the perimeter is a translucent portion of translucent body 14 that has no particular light refracting quality over any other portion of translucent body 14 as a bulk material. Another example of the means for receiving launched light energy at the perimeter is a translucent portion of translucent body 14 at a location thereof such that launched light 48 that is launched substantially perpendicularly to first side surface 28 passes into translucent body 14 and is reflected from first reflective surface 24. Thereby, this means for receiving launched light energy at the perimeter is a portion of translucent body 14 that is noted as light receiver lens 22. Under specific conditions, the means for receiving launched light energy may be a refractive configuration of light receiver lens 22 that substantially redirects light onto first reflective surface 24 within a preferred angle that assures and/or optimizes a substantial portion of launched light being reflected along first side surface 28 towards arcuate surface 16 or other parts of connector 10.

The means for broadcasting the light energy out of at least a portion of the perimeter of connector 10 may be a substantially translucent portion of connector 10 in a region that is visible to a user such as arcuate surface 16, a first product identifier 34, a second product identifier 36, and the like. For example, in connector 10 as seen in FIG. 2A, the means for broadcasting the light energy out of at least a portion of the connector perimeter comprises first reflective surface 24 that redirects launched light 48 along first side surface 28. Another example of the means for broadcasting light energy is second bevel 20 that redirects launched light 48 through arcuate surface 16. Another example of the means for broadcasting the light energy is arcuate surface 16 that may release a substantial portion of launched light 48. Still another example of the means for broadcasting the light energy is second reflective surface 26 that may reflect and redirect a substantial portion of launched light 48 that has not escaped translucent body 14. Another example of the means for broadcasting the light energy is first product identifier 34 and/or second product identifier 36 through which at least a portion of launched light 48 passes, thus illuminating either of first product identifier 34 or second product identifier 36. As such, any of the aforementioned structures may serve singly as a means for broadcasting the light energy out of at least a portion of the connector perimeter. Alternatively, any permutation of the aforementioned structures may serve as a means for broadcasting the light energy out of at least a portion of the connector perimeter. Finally, a means for broadcasting the light energy out of at least a portion of the connector perimeter may simply be translucent body 14 where a light source is of a sufficient luminosity that preferred structures such as those aforementioned are not required.

In one embodiment, launched light 48 passes through light receiver lens 22, is redirected off first reflective surface 24 and passes through translucent body 14 near first side surface 28. Thereafter, launched light 48 continues to propagate against left bevel 20, that also acts as a reflective surface, and launched light 48 illuminates arcuate surface 16 after which any unescaped portion of launched light 48 may be reflected and redirected by a second reflective surface 26. As such, any unescaped portion of launched light 48 may then repropagate out of translucent body 14 through arcuate surface 16, through first product identifier 34, through second product identifier 36, or through other structural portions of connector 10. Thus, throughout the transmission of launched light 48, portions thereof may also be escaping out of connector 10 through such surfaces as first side surface 28, and left- and right-bevel 20, 18.

When viewed on its left side, as seen in FIG. 2C, launched light may be seen to be exiting from first side surface 28, from left bevel 20, and from arcuate surface 16. The presence of second reflective surface 26 assists in substantially preventing some of launched light 48 from passing against right bevel 18 and down translucent body 14 along second side surface 30. Thereby, launched light 48 may be concentrated to exit from connector 10 primarily in regions such as arcuate surface 16. When viewed on its front edge, as seen in FIG. 2D, first product identifier 34 may be formed integrally as a portion of arcuate surface 16. Thereby, as launched light 48 exits connector 10, first product identifier 34 is illuminated. As seen in FIG. 2A, launched light 48 exiting connector 10 may also pass out of translucent body 14 in a region near a second product identified 3 6. Thereby, as connector 10 is seen in plan view as seen in FIG. 2D, second product identifier 36 may be seen by launched light 48 passing through that region.

The specific geometry of reflective surfaces and of a given connector may be configured so as to cause launched light to exit through preferred portions of the connector.

Figure 3:
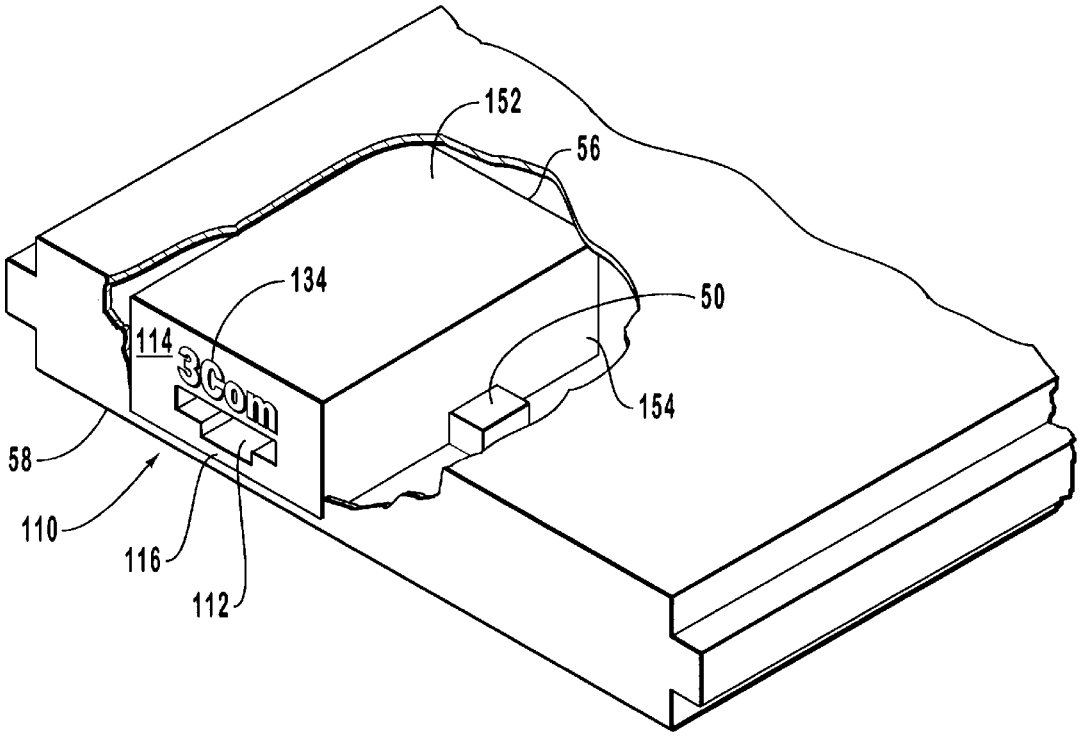
FIG. 3 is a perspective view of an inventive jack that is fixed in the edge of a computer and that is illuminated by an LED.

FIG. 3 illustrates another embodiment of the present invention wherein it can be seen that a fixed connector 110 is made of a translucent body 114 and an aperture 112. Fixed connector 110 is illuminated by light source 50 such as an LED. Fixed connector 110 may be illuminated with no selected reflective surfaces placed therein. Thereby, light source 50 launches light into fixed connector 110 and substantially all launched light exits through a front surface 116 of fixed connector 110. With this type of connector, because it remains substantially fixed within a PCMCIA structure, interior surfaces such as a visible top surface 52, or a visible first side surface 54 and others not shown may be treated with a reflective material so as to cause substantially all of launched light 48 to exit through front surface 116. A product identifier 134 may also be formed integrally with translucent body 114. The placement of light source 50 may be for example on first side surface 54 at a rear surface 56 or elsewhere for a preferred illumination of fixed connector 110 at front surface 116.

Although not illustrated in FIG. 3, it is understood that such structures as light receiver lens 22, first reflective surface 24, second reflective surface 26, and even first bevel 18 and second bevel 20 may be part of the structure within translucent body 114. Such structures may be located within translucent body 114 so as to preferably reconfigure and redirect launched light 48 so as to make a preferred display. Thus, structures may be located in generally the same locations as those illustrated in FIGS. 2A–2F.

Additionally, more than one occurrence of light source 50 may be placed along any portion of the perimeter of fixed connector 110 where a multi-colored display is desired. It is understood that light source 50, when provided in a plurality, may be any combination of colors that are available to the fabricator. For example, light source 50 may be a first red LED and a second green LED. Other colors may be used such as blue, yellow, and even white light.

Figure 4A:
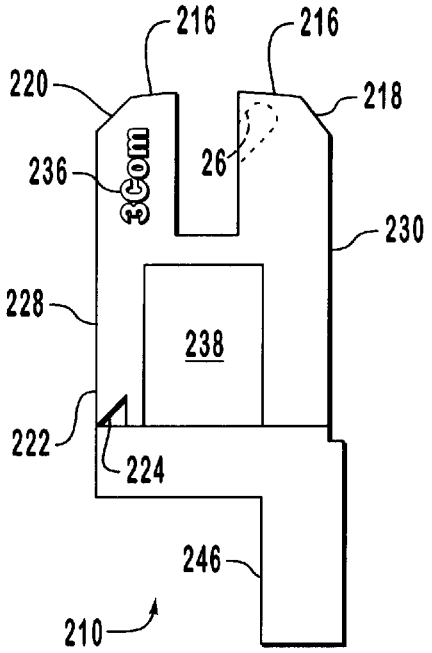
FIG. 4*a* is a top plan view of an inventive alligator jack.
Figure 4B:
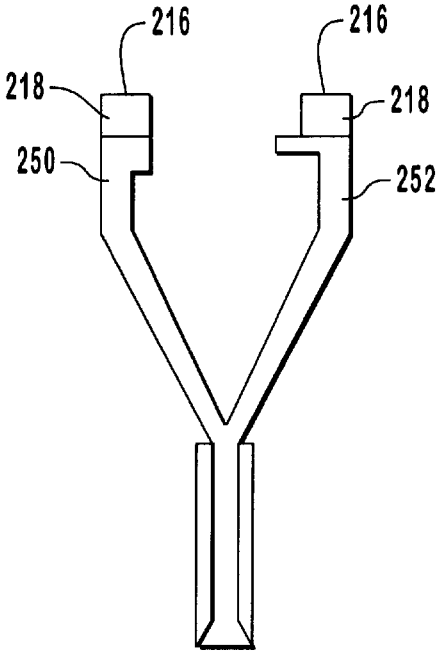
FIG. 4*b* is an elevational side view of the inventive alligator jack.

FIG. 4 illustrates another embodiment of the present invention where it can be seen that an alligator connector 210 is made of a translucent body 214 and an aperture 212. Alligator connector 210 is illuminated by light source 50 (not pictured) such as an LED. Alligator connector 210 may be illuminated with no selected reflective surfaces placed therein. Thereby, light source 50 launches light into alligator connector 210 and substantially all launched light exits through a front surface 216 of alligator connector 210. As seen in FIG. 4B with this type of connector, because the upper portion 250 is more visible to the user than the lower portion 252, substantially all of launched light 48 may be directed into upper portion 250. A product identifier 234 may also be formed integrally with translucent body 214.

It may be appreciated that the particular connector that is required for a given application may be an XJACK, an embedded connector such as for the reception of a Telco or LAN cable, an alligator connector, and other computer connectors. Additionally, the coating of portions of translucent body 14, seen in FIGS. 2A to 2F, seen in FIG. 3, or see in FIGS. 4A to 4B, may be carried out so as to substantially concentrate broadcasting portions of launched light 48 as it exits connector 10, fixed connector 110, or alligator connector 210.

In general, the connector is made of a material that passes UL® standards for both flammability, electrical resistivity, and structural strength. A preferred material is LEXAN 940® which is polycarbonate with a UL-approved flammability rating. Flammability ratings that are preferred in the present invention include V0, V1, V2, V3, and V4. A flammability rating that is preferred is a 5V rating. Another flammability rating that is preferred is a horizontal burn (HB) rating. Another flammability rating that is preferred is a 94-V0 rating. Other materials that are suitable LEXAN 940A®, LEXAN 920®, and LEXAN 920A®. Another material that may be used for the present invention is polysulphone. Another material that may be used for the present invention is polyester. Another material that may be used for the present invention is polyvinyl chloride (PVC). Another material that may be used for the present invention is styrene acrylonitrile (SAN). Another material that may be used for the present invention is glass. Additionally, a plurality of light sources may be used so as to send multi-colored display messages to the user. For example, as seen in FIG. 2A, launched light 48 may reflect off of first reflective surface 24 to substantially illuminate connector along first side surface 28 and out of arcuate surface 16. A second color of launched light may originate from a separate light source such that it also broadcasts light through light receiver lens 22 against first reflective surface 24 to substantially illuminate connector 10 throughout translucent body 14 in the area of first side surface 28 and out of arcuate surface 16.

Figure 5:
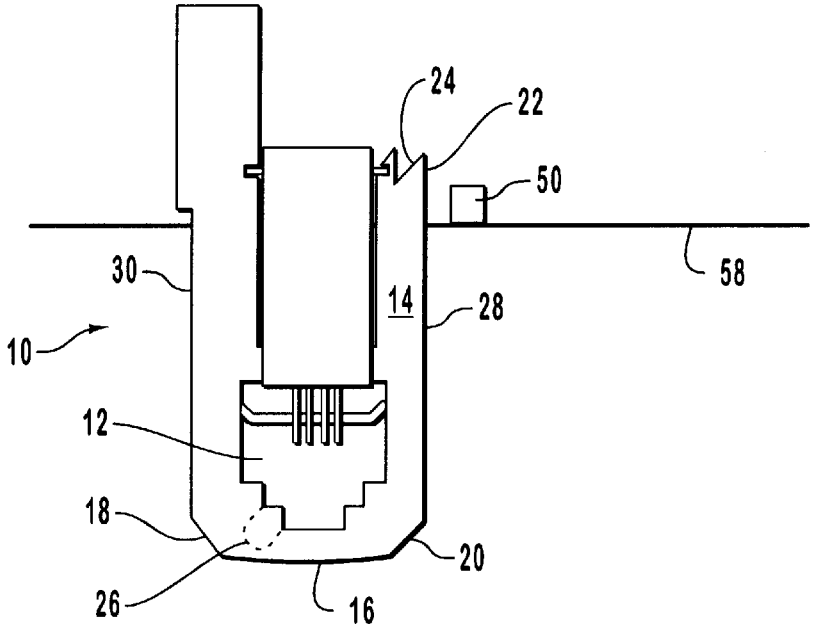
FIG. 5 is a schematic plan view of an XJACK that is slidably disposed at the edge of an electronic device and that is illuminated by an LED that is set to launch light against a reflective surface.

FIG. 5 is an illustration of XJACK connector 10 that demonstrates the relationship between first reflective surface 24 and light source 50. After the release of XJACK connector 10 such that it sticks out beyond the edge 58 of a PCMCIA device or the edge of an electronic device in general, it can be seen that light source 50 broadcasts launched light 48 substantially directly through light receiver lens 22 at first reflective surface 24. Thereafter, launched light 48 is piped throughout translucent body 14 along the region of first side surface 28 and is redirected at second bevel 20 such that at least a portion of launched light 48 may exit connector 10 through arcuate surface 16. A spring (not pictured) is configured within the spring sleeve 46 that is of sufficient strength so as to cause XJACK connector 10 to extend to its full length as designed so as to align light source 50 with first reflective surface 24.

Although XJACK connector 10, fixed connector 110, or alligator connector 210 has been set forth as having reflective surfaces such as first reflective surface 24, right bevel 18, left bevel 20, and second reflective surface 26, it is understood that where light source 50 is placed to direct launched light 48 into connector 10, fixed connector 110, or alligator connector 210 there may be no need to form any reflective surfaces. The absence of any reflective surfaces or the reduced number thereof may come due to the placement and/or intensity of light source. Preferably, such a structure without any reflective surfaces or with a reduced number thereof will occur in a given connector.

In another embodiment of the present invention, a PCMCIA card or any structure that carries an inventive connector can be configured with a single occurrence of light source 50 such that either connector 10, fixed connector 110, or alligator connector 210 can be installed there within interchangeably. As seen in FIG. 2E, the rear of an XJACK connector 10 is illustrated wherein two runners 42 that form the back portion of contact pins 40 are configured to make contact to metallized tracks 4 (not depicted) that are part of a PCB. Thus, connector 10, fixed connector 110, and alligator connector 210 are interchangeable. However, the placement of light source 50 will preferably be near edge 58 of a PCMCIA card and any reflective surface such as first reflective surface 24 will be configured so as to substantially receive launched light 48 that penetrates perpendicularly through light receiver lens 22.

Another embodiment of the present invention includes a PCMCIA card that is connected to connector 10, fixed connector 110, or alligator connector 210 with a flexible circuit that connects connector 10, fixed connector 110, or alligator connector 210 to the PCMCIA card or any structure that electronically communicates to connector 10, fixed connector 110, or alligator connector 210.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An electronic device enclosed within a housing having physical dimensions conforming substantially to the PCMCIA standard, the device comprising:

a connector that is capable of being extended and retracted from within the PCMCIA housing the connector having a receptacle formed therein for operatively receiving an electrical plug, and wherein at least a portion of the connector is formed with a substantially translucent material capable of emitting light energy;

at least one light source capable of emitting light energy;

at least one light receiving portion providing a light conducting path between the light energy emitted by the at least one light source and the translucent portion of the connector;

whereby at least a portion of the connector is visibly illuminated.

2. A PCMCIA electronic device as defined in claim 1, further comprising at least one reflective surface that is oriented to redirect the light energy so that it is emitted from at least one predetermined surface of the connector, whereby the at least one predetermined surface is visibly illuminated.

3. A PCMCIA electronic device as defined in claim 1, wherein at least a portion of the light energy is emitted into a portion of the receptacle, whereby the receptacle is visibly illuminated so as to at least partially illuminate the electrical plug received therein.

* * * * *

UNITED STATES PATENT AND TRADEMARK OFFICE

CERTIFICATE OF CORRECTION

PATENT NO. : 6,159,037
DATED : December 12, 2000
INVENTOR(S) : Brent D. Madsen; Paul Nagel It is certified that error appears in the above-identified patent and that said Letters Patent is hereby corrected as shown below:

Column 5,
Line 45, after "present invention." change "FIG. 2D" to -- FIG. 2A --

Column 7,
Line 39, after "view as seen in" change "FIG. 2D" to -- FIG. 2A --
Line 56, after "visible top surface" change "52" to -- 152 --
Line 57, after "visible first side surface" change "54" to -- 154, --
Line 62, after "side surface" change "54" to -- 154 --

Column 8,
Line 27, after "A product identifier" change "234" to -- 236 --

Signed and Sealed this

Eighteenth Day of December, 2001

*Attest:*

*Attesting Officer*

JAMES E. ROGAN
*Director of the United States Patent and Trademark Office*